US010662025B2

(12) United States Patent
Felder et al.

(10) Patent No.: US 10,662,025 B2
(45) Date of Patent: May 26, 2020

(54) OPERATING PANEL FOR AN ELEVATOR WITH SPLASH WATER PROTECTED KEY SWITCH

(71) Applicant: Inventio AG, Hergiswil NW (CH)

(72) Inventors: Hugo Felder, Buchrain (CH); Quan Fu Zhuo, Shanghai (CN)

(73) Assignee: INVENTIO AG, Hergiswil NW (CH)

( * ) Notice: Subject to any disclaimer, the term of this patent is extended or adjusted under 35 U.S.C. 154(b) by 257 days.

(21) Appl. No.: 15/758,891

(22) PCT Filed: Sep. 9, 2016

(86) PCT No.: PCT/EP2016/071244
§ 371 (c)(1),
(2) Date: Mar. 9, 2018

(87) PCT Pub. No.: WO2017/042305
PCT Pub. Date: Mar. 16, 2017

(65) Prior Publication Data

US 2018/0305173 A1 Oct. 25, 2018

(30) Foreign Application Priority Data

Sep. 11, 2015 (EP) ..... 15184815

(51) Int. Cl.
*B66B 1/34* (2006.01)
*B66B 1/46* (2006.01)

(52) U.S. Cl.
CPC ..... *B66B 1/465* (2013.01); *B66B 1/461* (2013.01)

(58) Field of Classification Search
CPC ..... B66B 1/465; B66B 1/461
(Continued)

(56) References Cited

U.S. PATENT DOCUMENTS 5,829,554 A * 11/1998 Benson ..... B66B 1/466 187/414
6,227,335 B1 * 5/2001 Koeppe, Jr. ..... B66B 1/462 187/395

(Continued)

FOREIGN PATENT DOCUMENTS

CN 1233066 A 10/1999
CN 1489547 A 4/2004

(Continued)

OTHER PUBLICATIONS

Schaefer GmbH, "MS 42 P-V Micro Key Switch 42 with profile half cylinder, Vario", 2013, Schaefer GmbH, Germany.

*Primary Examiner* — Anthony J Salata
(74) *Attorney, Agent, or Firm* — William J. Clemens; Shumaker, Loop & Kendrick, LLP

(57) ABSTRACT

An operating panel for an elevator includes a panel plate having an opening, a key switch arrangement and, optionally, a human machine interface attached to the panel plate. The switch arrangement includes a cover arrangement, a hinge and a key switch. The key switch is attached to the cover arrangement and is activated or deactivated by a key for transmitting activation signals to the elevator control upon activation. The cover arrangement is attached to the panel plate via the hinge and is displaced between a first configuration in which the key switch is arranged behind the cover arrangement and a second pivoted configuration in which the key switch is accessible from the front side of the panel plate. Thus, the key switch is protectively stored in the first configuration, providing splash water protection and an attractive visual appearance, and is pivoted to the second configuration when needed.

16 Claims, 5 Drawing Sheets

(58) Field of Classification Search
USPC ..... 187/247, 277, 391, 393, 395, 396, 397, 187/398, 399
See application file for complete search history.

(56) References Cited

U.S. PATENT DOCUMENTS

| | | | | |
|---|---|---|---|---|
| 6,357,553 | B1 * | 3/2002 | Vialonga | B66B 1/468 187/385 |
| 6,378,661 | B1 * | 4/2002 | Arabori | B66B 11/0015 187/250 |
| 7,237,655 | B2 * | 7/2007 | Kocher | B66B 5/005 187/314 |
| 7,318,501 | B2 * | 1/2008 | Felder | B66B 1/462 187/391 |
| 7,404,470 | B2 * | 7/2008 | Felder | B66B 1/462 187/395 |
| 7,798,291 | B2 * | 9/2010 | Felder | B66B 5/021 187/395 |
| 8,350,680 | B2 * | 1/2013 | Cole | G04G 11/00 187/247 |
| 8,746,415 | B2 * | 6/2014 | Aluisetti | B66B 1/468 187/391 |
| 2006/0054421 | A1 * | 3/2006 | Ikeda | B66B 1/462 187/395 |

FOREIGN PATENT DOCUMENTS

| | | | |
|---|---|---|---|
| CN | 101723224 | A | 6/2010 |
| CN | 202159616 | U | 3/2012 |
| GB | 917637 | A | 2/1963 |
| JP | S5696065 | U | 7/1981 |
| JP | S57131560 | U | 8/1982 |

* cited by examiner

OPERATING PANEL FOR AN ELEVATOR WITH SPLASH WATER PROTECTED KEY SWITCH

FIELD

The present invention relates to an operating panel for an elevator, particularly for a firefighter elevator.

BACKGROUND

Elevators are generally used for transporting persons or material from one level to another level for example in a building. The elevator comprises a car which may be moved between the various levels using a drive unit. The drive unit is controlled by an elevator control.

In order to enable activation of the elevator control to drive the car to a specific level, operating panels are typically provided in the car and/or at the floor levels. For example, a car operating panel (COP) may be provided within the car such that a person may use this car operating panel in order to indicate his request to move the elevator car to a specific floor level. Lobby operating panels (LOP) may be provided in floors at various floor levels of a building such that a user may indicate his request that the elevator car shall be driven to the respective floor.

While normal operation functions of the elevator should be accessible to all users, there may be specific functions of the elevator which shall only be accessible for authorized personnel. For example, there may be an elevator function of prioritized use of the elevator such that, upon activating this function, the elevator may exclusively be controlled by the authorized personnel.

Particularly, the elevator may have restricted functions to which only authorized firefighters shall have access. Additional to for example a prioritized use of the elevator according to which, in case of fire, e.g. non-authorized persons may be prevented from using the elevator, such restricted firefighter functions may include various other functions such as enabling driving the elevator car to positions which are not accessible under normal operation conditions of the elevator, setting the elevator into a "firefighter mode" in which for example specific security options are activated, etc.

In order to authorize access to such restricted elevator functions, one or more of the operating panels typically comprises a key switch. Upon activating the key switch by inserting a key and, optionally, turning the key, enabling of restricted elevator functions may be authorized.

As a correct functioning of the key switch may be relevant for a security of the elevator and its users, the key switch should specifically be protected for example against external influences. For example, the key switch should be protected against splash water, particularly in case that the key switch is provided for enabling restricted firefighter functions.

Accordingly, there may be a need for an operating panel for an elevator and for an elevator comprising such operating panel in which the key switch is suitably protected against external influences such as for example against splash water. Furthermore, there may be a need for an operating panel including a key switch requiring a small installation space and/or having a positive visual appearance.

SUMMARY

According to a first aspect of the present invention, an operating panel for an elevator is proposed, the operating panel comprising a panel plate, and a key switch arrangement. The panel plate has an opening for example in a form of a square or circular through-hole. The key switch arrangement comprises a cover arrangement, a hinge and a key switch. Therein, the key switch is mechanically attached to the cover arrangement and is adapted for being activated or deactivated by a key being inserted into the key switch and to transmitting activation signals to the elevator control upon such activation. The hinge is attached to the panel plate next to the opening in the panel plate. The cover arrangement is attached to the panel plate via the hinge and may be displaced between a first configuration in which the key switch is arranged behind the cover arrangement and a second pivoted configuration in which the key switch is accessible from the front side of the panel plate.

Ideas underlying embodiments of the present invention may be interpreted as being based, inter alia, on the following observations and recognitions.

As indicated in the introductory portion, key switches in an operating panel for an elevator may require specific protection against e.g. splash water, vandalism, physical exposure and/or other external influences.

Furthermore, including a key switch into an operating panel may have to comply with restricted space requirements within the operating panel and/or an elevator car accommodating the operating panel.

And last but not least, modern operating panels should provide for a pleasant visual appearance to a user. Such pleasant visual appearance may include that e.g. surfaces of the operating panel may be smooth or flush.

As described in further detail below, conventional key switches in elevator operating panels do usually not satisfy most or all of such requirements.

In the operating panel described herein, the key switch is part of a key switch arrangement. In this key switch arrangement, a cover arrangement is hinged to the panel plate of the operating panel such that the cover arrangement is at least partially accommodated within the opening of the panel plate. The cover arrangement is mechanically connected to the panel plate in such a manner such that it may be pivoted between a first configuration and a second configuration. The key switch is mechanically attached to the cover arrangement.

Therein, the cover arrangement is adapted such that and the key switch is attached to the cover arrangement such that, in the first configuration, the key switch is arranged behind the cover arrangement or at least behind portions of the cover arrangement. Such positioning behind the cover arrangement may be understood such that the key switch is arranged at a rear side of the operating panel and its panel plate and, as it is arranged behind the cover arrangement, is not accessible from a front side of the panel plate. This first configuration is the "normal" configuration of the operating panel. I.e. in normal operation of the elevator, the key switch is hidden behind the cover arrangement and is not accessible from a front side.

However, from such first configuration, the cover arrangement may be pivoted into the second configuration, for example by pivoting the cover arrangement in an angle of between 20 to 180°, preferably in an angle between 80 and 100°. By pivoting the cover arrangement, the key switch attached to the cover arrangement is displaced to a position where it is not any more arranged behind the cover arrangement but may be accessed from a front side of the panel plate. Accordingly, in such second pivoted configuration, the key switch may be activated by inserting a key into the key switch.

Attaching the key switch to a pivotable cover arrangement may enable, inter alia, suitable protection of the key switch against external influences, particularly during normal operation of the elevator in which the key switch is hidden behind the cover arrangement. Furthermore, such approach may, at the same time, enable a smooth and pleasant visual appearance of the operating panel as, during normal operation, the cover arrangement hides the key switch in the first configuration such that the key switch does not disturb any visual appearance of the operating panel.

According to an embodiment, the cover arrangement is sized such as to completely cover or fill out the opening of the panel plate when the cover arrangement is positioned in the first configuration.

In other words, at least portions of the cover arrangement form a two-dimensional structure which completely covers or fills out the opening of the panel plate and thereby substantially closes the opening when the cover arrangement is positioned in the first configuration.

Accordingly, as the opening is closed by the cover arrangement, the key switch being arranged behind the cover arrangement cannot be accessed through the opening from an environment in front of the panel plate. Accordingly, the key switch is protected by the cover arrangement against environmental influences when the cover arrangement is in the first configuration. Furthermore, the cover arrangement may hinder environmental influences from entering an inside of the operating panel through the opening.

According to an embodiment, the cover arrangement has an essentially L-shaped cross-section with the cover arrangement comprising a first branch section and a second branch section being arranged transverse to each other.

Therein, the cover arrangement may comprise two substantially planar two-dimensional sections which are arranged transverse to each other, for example in an angle of between 30° and 150°, preferably between 80° and 100°, more preferably being substantially rectangular to each other. The cover arrangement including its branch sections may be made from one piece or from several pieces. For example, the cover arrangement may be made with a bent metal sheet. Alternatively, the cover arrangement may be made with a plastic component forming the two branch sections wherein such plastic component may be made for example by injection molding. As a further alternative the cover arrangement may also be produced by a tension profile.

The key switch may be attached to one of the branch sections at a position such that the key switch is arranged behind this branch section or the other branch section when the cover arrangement is in the first configuration. Due to the L-shaped cross-section, the cover arrangement may even better protect the key switch preferably in both the first and the second configuration.

According to a specific embodiment, the first branch section is sized such as to completely cover or fill out the opening of the panel plate when the cover arrangement is positioned in the first configuration.

In other words, with a cover arrangement comprising two branch sections, the first branch section is preferably sized and configured such that it may close the opening in the panel plate and thereby protect the key switch which is arranged behind this first branch section when the cover arrangement is in the first configuration.

Furthermore, the second branch section may be adapted such as to completely cover or fill out the opening of the panel plate when the cover arrangement is positioned in the second configuration.

In other words, while the first branch section of the in cross-section L-shaped cover arrangement may close the opening in the panel plate while being in the first configuration, the second branch section may close this opening while the cover arrangement being in the second configuration. Accordingly, in both configurations, the opening in the panel plate is closed by one of the branch sections of the cover arrangement.

Due to such closing of the opening, any access of external influences to for example parts of an elevator control, an energy supply or any other device arranged behind the panel plate may be hindered such that these parts or devices are protected both when the cover arrangement being in the first or in the second configuration.

According to a specific embodiment, the first and second branch sections of the cover arrangement and the hinge of the key switch arrangement are arranged such that the second branch section is positioned above, i.e. vertically on top of or over, the key switch when the cover arrangement is in the second configuration.

In other words, the cover arrangement with its L-shaped cross-section is arranged and hinged to the panel plate such that, when it is pivoted into the second configuration in which the key switch is accessible from the front side of the operating panel, the second branch section of the cover arrangement is arranged above the key switch.

Due to the second branch section being arranged above the key switch, this key switch may be protected against any external influences coming from above the key switch, i.e. falling onto the key switch. Particularly, the second branch section above the key switch may protect the key switch against splash water which, for example in case of fire emergency, may be splashing into the elevator car upon attempts of extinguishing a fire.

According to an embodiment, the operating panel may further comprise a sealing for tightly closing an interface between a border of the opening of the panel plate and the cover arrangement.

In other words, a sealing may be provided such that it may seal for example a gap or interface between the panel plate in a region close to the opening in the panel plate and the cover arrangement. The sealing may be adapted for tightly closing such gap or interface. For example, a geometry of the sealing may be adapted such as to follow a contour of an outer circumference of the cover arrangement and/or in inner contour of the opening. Furthermore, a material of the sealing may be flexible and/or elastic and may be e.g. rubber, silicone or similar materials.

Accordingly, due to such sealing, entering of any substances such as splash water from a front side of the panel plate through such gap or interface into a space at the rear side of the panel plate may be effectively prevented. Such sealing may be adapted such as to tightly closing the opening when the cover arrangement is in the first configuration and/or in the second configuration.

According to an embodiment, the hinge is adapted and arranged such that the cover arrangement may be pivoted from the first configuration to the second configuration in a vertical direction.

In other words, the cover arrangement may be hinged to the panel plate such that it may be pivoted up and down from the first to the second configuration and vice versa. In such vertical pivoting implementation, the cover arrangement may be easily adapted to efficiently closing the opening in the panel plate both in the first and second configuration. For example, in the embodiment described above in which the cover arrangement has an essentially L-shaped cross-section, both branch sections of the cover arrangement may have a similar or same geometry and size such that one of the branch sections may close to the opening in the panel plate when being in the first configuration and the other branch section may close this opening when being in the second configuration.

In an alternative embodiment, the hinge is adapted and arranged such that the cover arrangement may be pivoted from the first configuration to the second configuration in a horizontal direction.

In other words, in such approach, the cover arrangement may be hinged to the panel plate such that it may be pivoted from left to right from the first to the second configuration and vice versa. In such horizontal pivoting implementation, the cover arrangement may be adapted for example such that the key switch arrangement requires only little installation depth behind the panel plate.

According to an embodiment, the key switch comprises a key cylinder which is not specifically protected against splash water.

In other words, while key switches in conventional operation panels frequently are specifically protected against splash water using for example sealing arrangements or membrane arrangements in a key cylinder, the key switch applied in the present operating panel does not necessarily require such specific splash water protection. The splash water protection may be dispensable as, for example in the first configuration of the cover arrangement, the key switch is arranged behind the cover arrangement and is thereby protected against splash water. Furthermore, for example in the second configuration of the cover arrangement, portions of the cover arrangement such as for example a second branch section extending above the key switch may protect the key switch against splash water. Accordingly, dispensing any splash water protection in the key cylinder of the key switch may allow using a simple, cheap and small key cylinder to be used in the key switch thereby reducing complexity, costs and size of the key switch arrangement in the operating panel.

According to an embodiment, the operating panel further comprises a spacer arrangement being interposed between the cover arrangement and a front portion of the key switch.

In other words, a spacer arrangement is provided at the cover arrangement such that the front portion of the key switch does not any more abut directly to a surface of the cover arrangement but is spaced therefrom by the intermediate spacer arrangement. The spacer arrangement may have any geometry suitable for disposing the front portion of the key by a desired distance from a surface of the cover arrangement. For example, the spacer arrangement may be a simple plastic or metal ring which may e.g. enclose the key switch at its lateral sides.

Due to such spacer arrangement, an installation depth of the key switch arrangement may be reduced such that installation space requirements in a region behind the panel plate may be reduced.

According to an embodiment, the cover arrangement is adapted such that a portion of the cover arrangement completely filling the opening of the panel plate when being in the first configuration is substantially flush with the front side of the panel plate.

In other words, a design and geometry of the cover arrangement may be chosen such that, when being in the first configuration, the cover arrangement or portions thereof completely fill the opening in the panel plate but do not protrude beyond a surface plane of the panel plate but are substantially flush with the front side surface of the panel plate.

Such flush closing of the opening of the panel plate may provide for a pleasant visual appearance of the operating panel. Furthermore, with such substantially flush arrangement, any vandalism to the operating panel may be impeded.

According to an embodiment, an information relating to a purpose or a handling of the key switch may be visualized at a front side of the cover arrangement.

In other words, in the first configuration, the cover arrangement covers and hides the key switch such that the key switch is not visible from outside the operating panel. In order to indicate a purpose of the cover arrangement and/or the key switch covered there behind, for example an inscription, engraving, label or icon may be applied to the front side of the cover arrangement such that for example a person standing in front of the operating panel may easily see and understand such visualization.

With such cover arrangement, aesthetical and design requirements may be fulfilled as, in the normal first configuration, the key switch is hidden behind the cover arrangement and does therefore not disturb the visual appearance of the operating panel while, on the other hand, a person searching for the key switch may easily and quickly find the key switch due to the visualization on the cover arrangement. I.e. for example a firefighter may quickly find the key switch for setting the elevator into a firefighter mode.

According to an embodiment, the operating panel may further comprise a human machine interface which is attached to the panel plate and is adapted for inputting operation instructions by a user upon actuation from a front side of the panel plate, i.e. the user may stand in front of the panel plate and may input operation instructions using the human machine interface. Furthermore, the human machine interface may be adapted for transmitting operation instruction signals to an elevator control.

According to a second aspect of the invention, an elevator is proposed, this elevator comprising an operating panel according to embodiments of the invention as described above.

Particularly, such elevator may be a firefighter elevator and the key switch may be adapted for transmitting activation signals to the elevator control upon activation in order to authorize enabling of restricted firefighter functions of the elevator. In such firefighter elevator, a splash water protection enabled by the specific key switch arrangement of the operating panel may be particularly beneficial.

It shall be noted that possible features and advantages of embodiments of the invention are described herein partly with respect to an operating panel and partly with respect to an elevator comprising such operating panel. One skilled in the art will recognize that the features may be suitably transferred from one embodiment to another and features may be modified, adapted, combined and/or replaced, etc. in order to come to further embodiments of the invention.

In the following, advantageous embodiments of the invention will be described with reference to the enclosed drawings. However, neither the drawings nor the description shall be interpreted as limiting the invention.

The figures are only schematic and not to scale. Same reference signs refer to same or similar features.

DETAILED DESCRIPTION

Conventionally, an operating panel of an elevator may comprise a key switch which may be activated by authorized personal using a key and thereby authenticating themselves as being authorized. Such key switch may include a standard key cylinder into which a key may be inserted and which, upon such key insertion, may for example be turned between an activated and a deactivated position.

As standard key cylinders are typically not specifically protected against external influences such as splash water, additional measures may have to be taken in case a key switch shall be operated under critical environmental condition.

For example, a specific sealing arrangement may be provided within the key switch or its key cylinder. However, such specific sealing arrangement may add significant complexity and/or costs to the key switch.

Alternatively, the key switch may be fixed at a panel plate of the operation panel and, additionally, an external hatch or flap may be attached to the panel plate and such hatch or flap may cover the underlying key switch as long as it is not used. In case access to the key switch is required, the hatch or flap may be displaced e.g. by pivoting it in an upside direction thereby exposing the underlying key switch. However, handling such hatch or flap may be troublesome. Furthermore, the hatch or flap may disturb an aesthetical visual appearance of the operation panel.

Figure 1A:
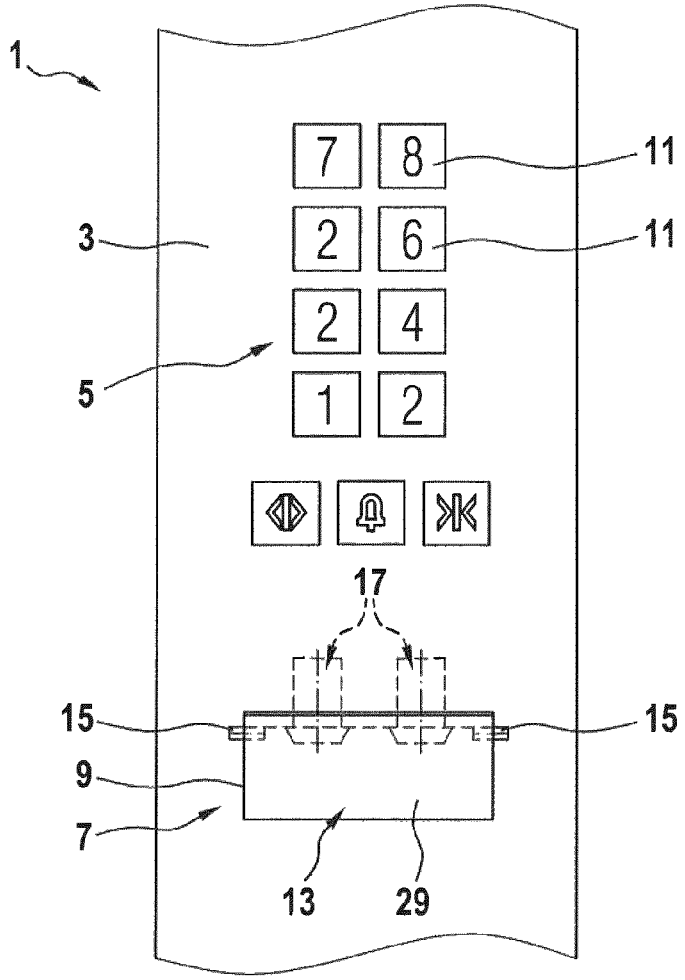
FIGS. 1*a,b,c* show a front view, a side view and a view from below of an operating panel according to an embodiment of the present invention in a first configuration.

FIGS. 1*a,b,c* show an operating panel 1 for an elevator according to an embodiment of the present invention in a front view, a side view and a view from below. The operating panel 1 comprises a panel plate 3, a human machine interface 5 and a key switch arrangement 7.

The panel plate 3 is a planar plate and may be for example part of a housing enclosing circuitry or electronics forming part of an elevator control. The panel plate 3 may be made for example with a metal plate, a plastic plate or any other kind of plate. The panel plate 3 may be planar. The panel plate 3 comprises a rectangular opening 9. The opening 9 may have any other contour and is a through-hole.

In the example shown, the human machine interface 5 is established with a plurality of push buttons 11. For ease of visualization, the human machine interface 5 is only shown in the front view of FIG. 1*a* and the side view of FIG. 1*b*. By pushing one of the push buttons 11, a user may input operation instructions for example for requesting a transfer of an elevator car to a specific floor or level. Additionally, the human machine interface 5 may comprise further push buttons for requesting e.g. opening or closing an elevator door or for initiating an alarm. Upon actuation of one of the push buttons 11, the human machine interface 5 may transmit corresponding operation instruction signals to an elevator control. Such elevator control or parts thereof may be accommodated for example behind the panel plate or at any other location within an elevator arrangement.

Instead of implementing the human machine interface 5 with push buttons 11, any other kind of human machine interface 5 may be used for the operating panel 1. For example, the human machine interface may be implemented by a plurality of switches which may be actuated for example mechanically by pressing a switch or capacitively by touching a surface of a switch. Alternatively, the human machine interface may be implemented in any other way such as for example with a touch-sensitive screen, which allows a user to input operation instructions which indicate his request to the elevator.

The key switch arrangement 7 comprises a cover arrangement 13, a hinge 15 and at least one key switch 17.

The key switch 17 is directly or indirectly attached to the cover arrangement 13. In the example shown (see FIG. 1*b*), the cover arrangement 13 comprises two through-holes 19. The key switch 17 comprises an enlarged front portion 21 and a cylindrical or rectangular body 23 having a smaller diameter/shape than the front portion 21. The key switch 17 is inserted with its cylindrical or rectangular body 23 into one of the through-holes 19 until the enlarged front portion 21 abuts to a surface of the cover arrangement 13. In such position, the key switch 17 may be fixed to the cover arrangement 13 by any suitable fixing means such as by a lock nut (not shown).

The key switch comprises a key cylinder 25 having a slot 27 into which a key may be inserted. Upon inserting the key into the slot 27 and, optionally, turning the key cylinder 25, the key switch 17 may be activated or deactivated and corresponding activation signals may be transmitted to the elevator control.

The cover arrangement 13 is pivotably attached to the panel plate 3 via the hinge 15. Any type of hinge 15 may be used. In the embodiment shown, the hinge 15 comprises two separate portions which are provided at both lateral sides of the cover arrangement 13 and are attached to the panel plate 3 next to the opening 9.

In the embodiment shown, the cover arrangement 13 comprises a first branch section 29 and a second branch section 31. The first and second branch sections 29, 31 extend rectangularly to each other. Both branch sections 29, 31 have a sheet-like two-dimensional structure. The cover arrangement 13 and its branch sections 29, 31 may be made for example from a metal sheet being bent into a suitable geometry. Alternatively, the cover arrangement 13 may be provided as a molded plastic device or tension profile.

The cover arrangement 13 may be pivoted around a rotation axis of the hinge 15. FIGS. 1*a,b,c* show a first configuration of the cover arrangement 13 in which the first branch section 29 is arranged within the opening 9 of the panel plate 3. Therein, the first branch section 29 has a geometry and size such as to completely fill out the opening 9 thereby substantially closing the opening 9 against any external influence. An outer surface of the first branch section 29 is substantially flush with an outer surface of the panel plate 3 thereby obtaining an attractive visual appearance.

One or more sealings 33 may be provided at a circumference of the first branch section 29 in order to tightly seal the cover arrangement 13 against the panel plate 3. The sealings may enclose the first branch section 29 in a ring-like manner. The sealing may close an interface or gap between the cover arrangement 13 and a border of the panel plate 3 at the opening 9 in a substantially water tight manner.

Furthermore, an additional water protection arrangement 45 may be provided. For example, an angular sheet may be fixed at an inner surface of the panel plate 3 e.g. underneath the opening 9. Such water protection arrangement 45 may be arranged and formed such that water which unintentionally enters though the opening 9 is hindered from reaching e.g. electronics or other water-sensitive components arranged behind the panel plate 3 but instead is collected in an area away from such water-sensitive components.

Figure 1B:
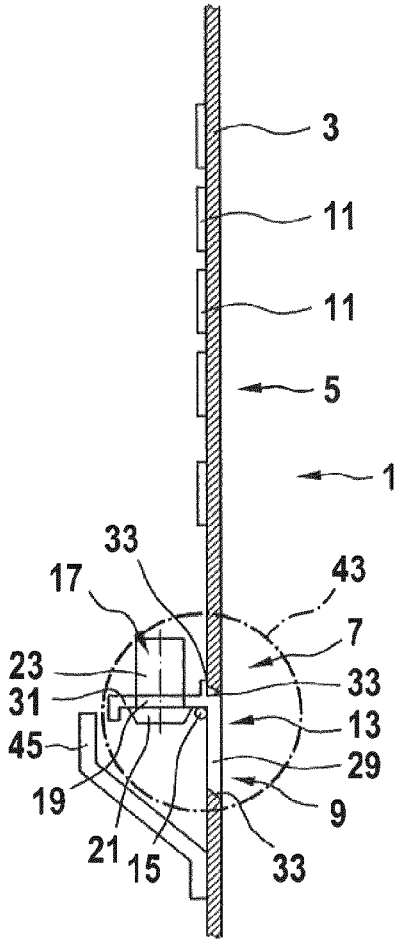
Figure 1C:
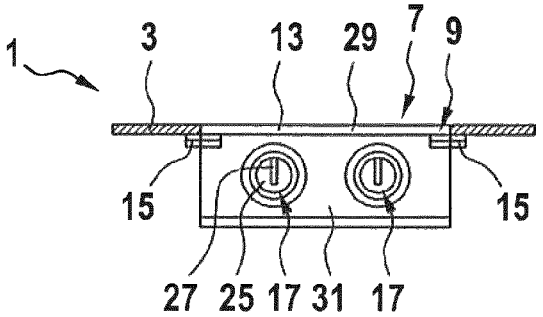
Figure 2A:
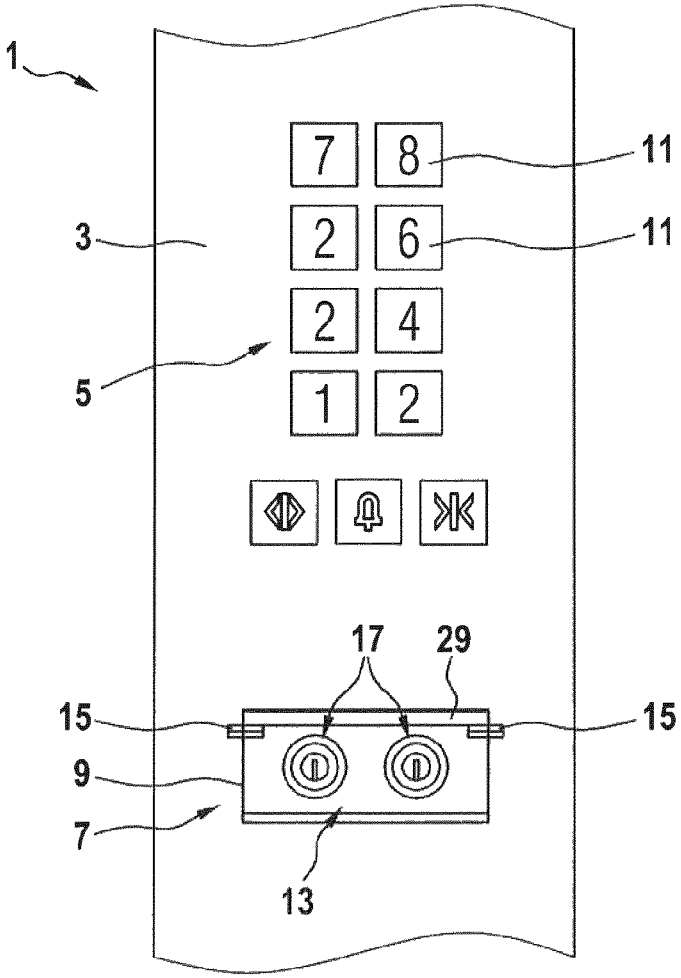
FIGS. 2*a,b,c* show a front view, a side view and a view from below of the operating panel of FIG. 1 in a second configuration.
Figure 2B:
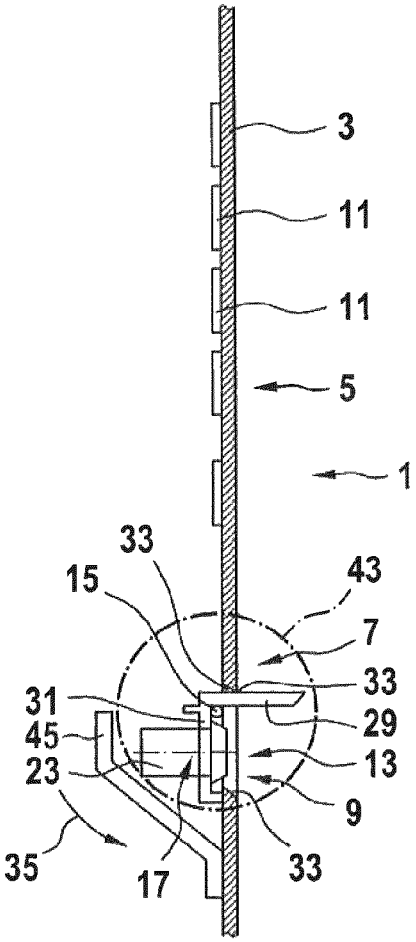

FIGS. 2*a,b,c* show the operation panel 1 of FIG. 1 with the cover arrangement 13 being in a second configuration. This second configuration may be assumed upon rotating the cover arrangement 13 around the axis of the hinge 15 in a vertical direction as indicated with the arrow 35 shown in FIG. 2*b*.

In such second configuration, the second branch section 31 is arranged such as to completely cover the opening 9 in the panel plate 3. Accordingly, while the second branch section 31 of the cover arrangement 13 closes the opening 9 in such second configuration, the key switch 17 is accessible from the front side of the panel plate 3 and may therefore be actuated for example by inserting a key into the slot 27. Sealings (not separately shown) may be provided in order to tightly seal an interface between the cover arrangement 13 and the panel plate in such second configuration.

The first branch section 29 is positioned slightly above the key switch 17 in such second configuration of the cover arrangement 13 such that this first branch section 29 extending in a horizontal direction acts like a roof. Accordingly, this roof-like first branch section 29 may prevent e.g. splash water from reaching the key switch 17 underneath.

Figure 3A:
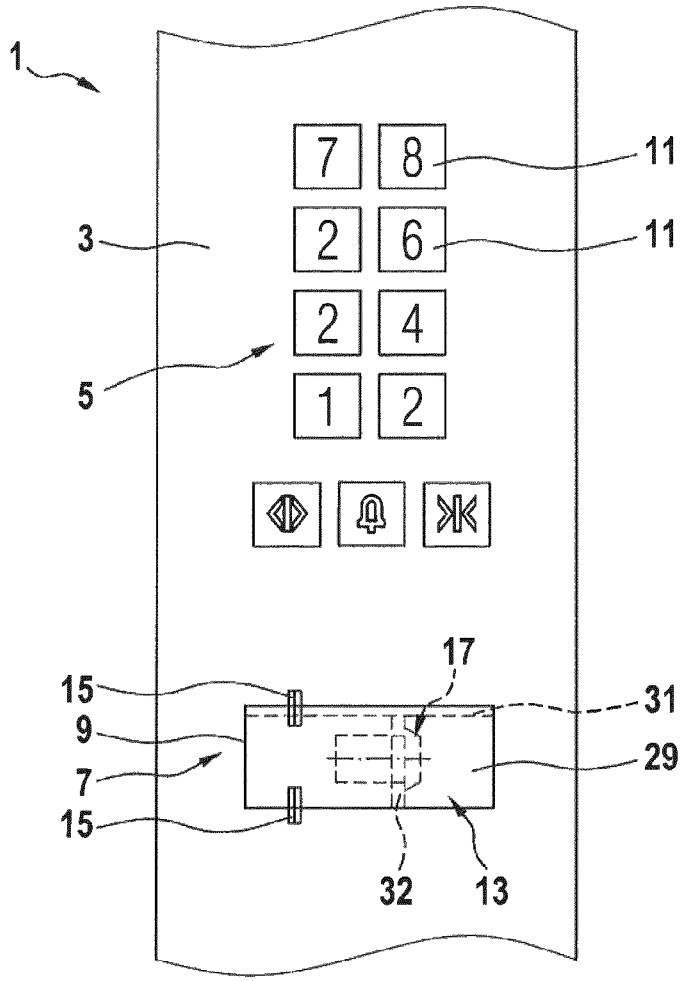
FIGS. 3*a,b,c* show a front view, a side view and a view from above of an operating panel according to another embodiment of the present invention in a first configuration.
Figure 3B:
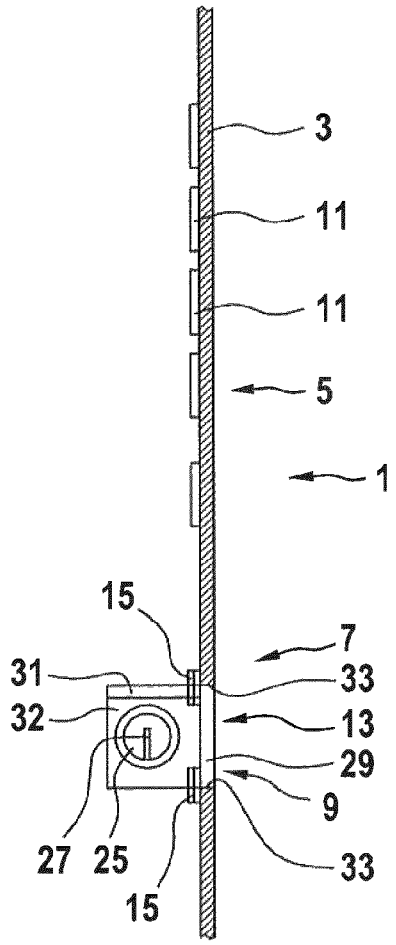
Figure 3C:
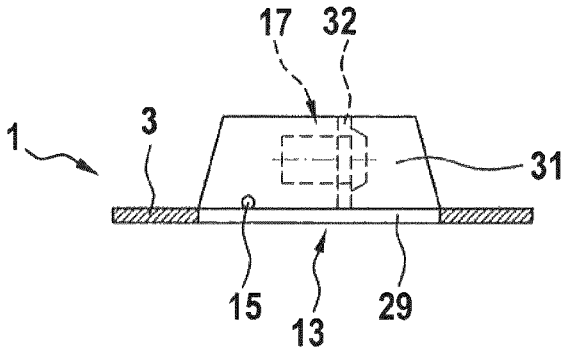
Figure 4:
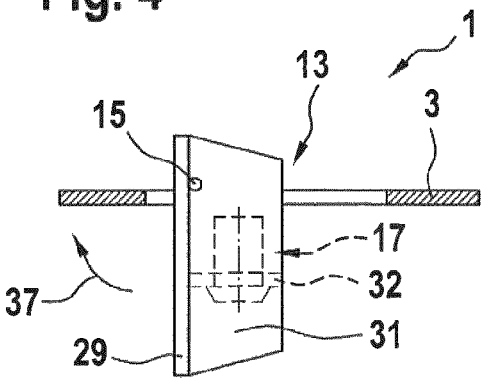
FIG. 4 shows a view from below of the operating panel of FIG. 2 in a second configuration.

FIGS. 3*a,b,c* show an operating panel 1 for an elevator according to another embodiment of the present invention in a front view, a side view and a view from above in a first configuration. FIG. 4 shows the same operating panel 1 in a view from above in a second configuration.

Therein, a key switch arrangement 7 is arranged such that it may be pivoted in a horizontal direction between the first and the second configuration. Portions of a hinge 15 are fixed to the panel plate 3 such that they form a vertical rotation axis. A cover arrangement 13 of the key switch arrangement 7 comprises a first branch section 29 and a second branch section 31 each being sheet-like and extending rectangular to each other. The first branch section 29 extends in a vertical plane whereas the second branch section extends in a horizontal plane and above a key switch 17. The key switch 17 is attached to the cover arrangement 13 at a third branch section 32 extending rectangularly to each of the first and second branch sections 29, 31. Accordingly, a longitudinal axis of the key switch 17 extends in parallel to the first and second branch sections 29, 31. All three branch sections 29, 31, 32 together preferably form an integrated part such that the cover arrangement 13 may be made e.g. by injection molding.

In the first configuration shown in FIGS. 3*a,b,c*, the first branch section 29 of the cover arrangement 13 closes the panel plate 3 by completely filling its opening 9. Therein, the first branch section 29 may be flush with the panel plate 3. The key switch 17 is oriented parallel to a surface of the panel plate 3 and does therefore require only a relatively small installation depth. In such first configuration, the key switch 17 is hidden behind the first branch section 29. The key switch 17 is therefore protected and may not be accessed from outside.

Upon turning the cover arrangement 13 around the axis of the hinges 15 in a horizontal direction 37, the cover arrangement 13 may be brought into its second configuration in which the key switch 17 may be accessed from outside, i.e. a key may be inserted into a key slot 27 by a user standing in front of the panel plate 3. In such second configuration, the key switch 17 is oriented rectangular to a front surface of the panel plate 3. Furthermore, the key switch 17 is protected against e.g. splash water from above due to the second branch 31 of the cover arrangement extending above the key switch 17 and acting like a roof.

Figure 5A:
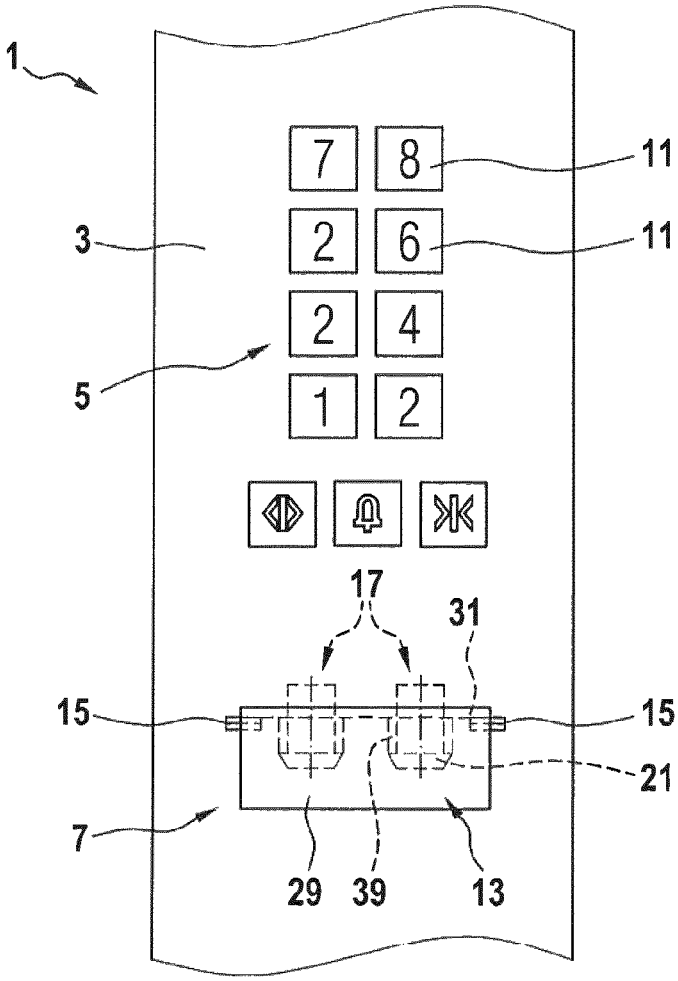
FIGS. 5*a,b* show a front view and a side view of an operating panel according to a further embodiment of the present invention in a first configuration.
Figure 6A:
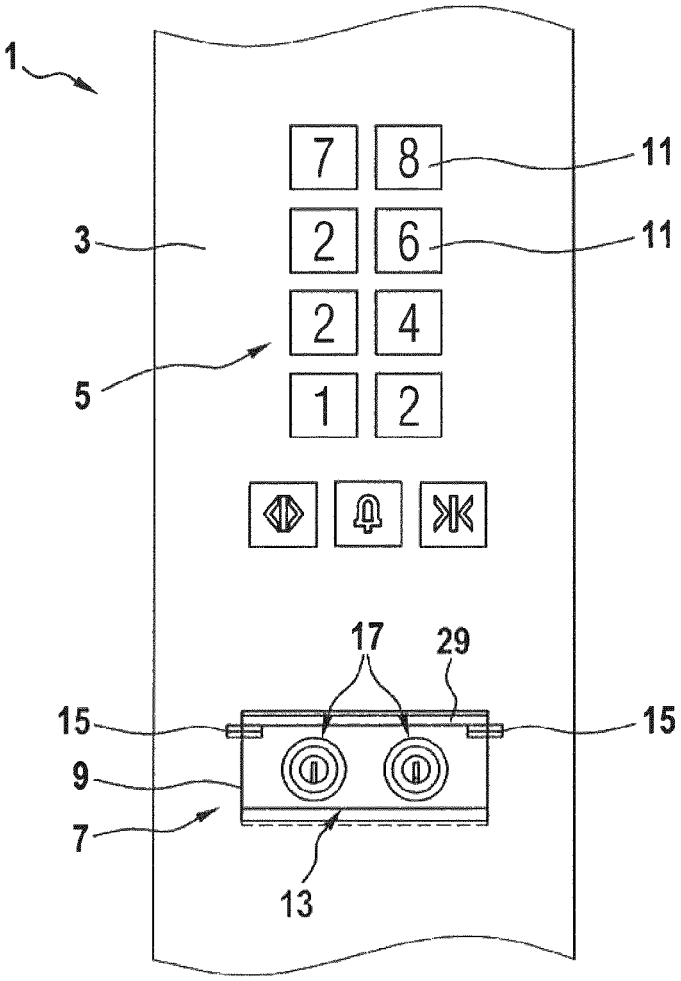
FIGS. 6*a,b* show a front view and a side view of the operating panel of FIG. 5 in a second configuration.

FIGS. 5*a,b* show an operating panel 1 for an elevator according to a further embodiment of the present invention in a front view and a side view in a first configuration. FIGS. 6*a,b* show the same operating panel 1 in a front view and a side view in a second configuration.

Figure 2C:
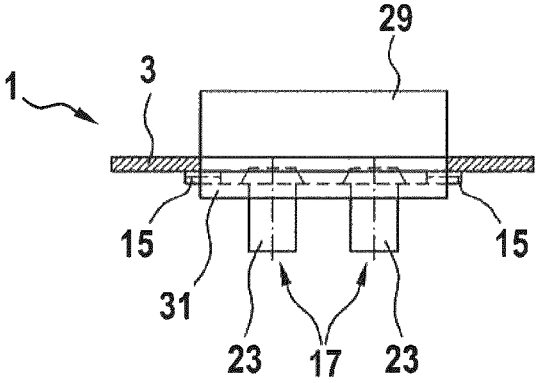
Figure 5B:
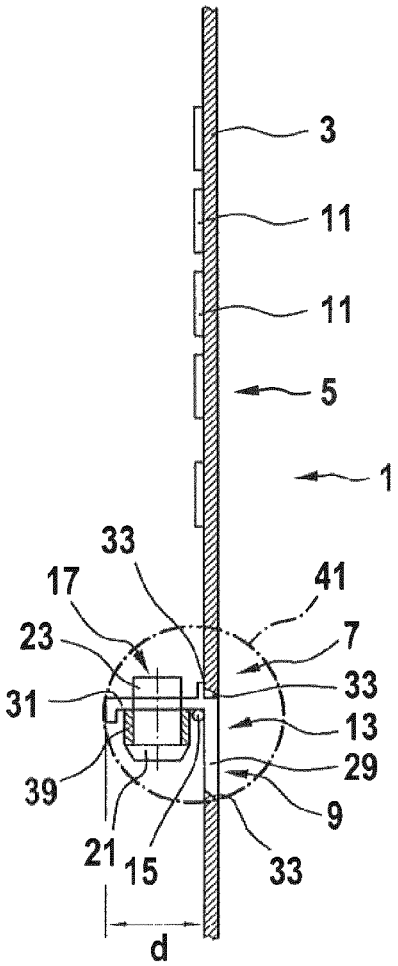
Figure 6B:
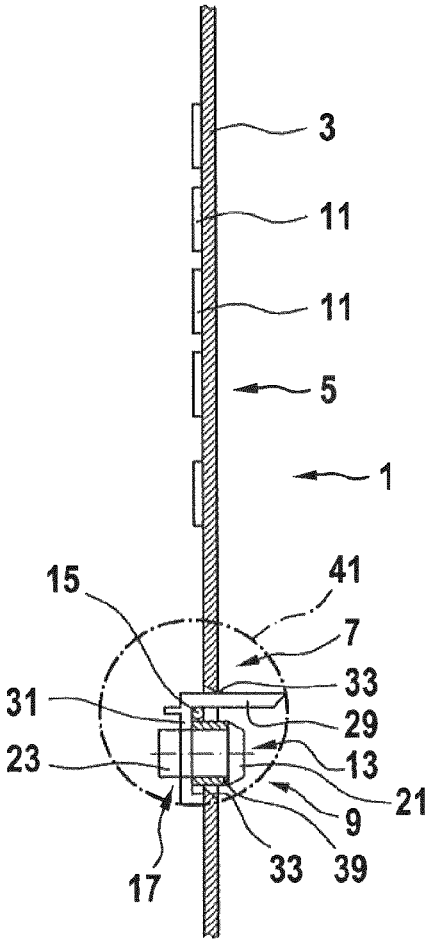

This embodiment is similar to the embodiment shown in FIGS. 1 and 2. However, in contrast to this preceding embodiment, the key switch 17 is fixed in a different manner to the cover arrangement 13. While in the embodiment of FIGS. 1 and 2, the enlarged front portion 21 of the key switch 17 directly abuts to a surface of the cover arrangement 13, the embodiment of FIGS. 5 and 6 includes an additional spacer arrangement 39 which is interposed between the cover arrangement 13 and the front portion 21 of the key switch 17. Such spacer arrangement 39 may comprise e.g. a cylindrical ring which encloses a partial portion of the body 23 of the key switch 17.

Due to such spacer arrangement 39, the key switch 17 does extend less far to a rear side of the cover arrangement 13 but instead protrudes beyond the front side of the second branch section 31 of the cover arrangement 13 to which it is attached. As a result, an installation depth for the switch arrangement 7, i.e. a distance "d" up to which the switch arrangement 7 extends behind the plane of the panel plate 3, may be smaller than in the embodiment of FIGS. 1 and 2.

This is visualized with the dotted circular line which indicates a maximum depth extension 41 of the components of the switch arrangement 7 during turning the switch arrangement 7 from the first to the second configuration. It may be seen that in the embodiment of FIGS. 5 and 6, such maximum depth extension mainly depends on a width of the first and second branch sections 29, 31 of the cover arrangement 13. In contrast hereto, without the spacer arrangement 39, i.e. in an embodiment as shown in FIGS. 1 and 2, such maximum depth extension 43 mainly depends on a length of the key switch 17, as indicated with the circular dotted line 43 in FIG. 1*b*, and is generally larger than the corresponding maximum 41 extension in the embodiment of FIGS. 5 and 6.

In another alternative embodiment which is not visualized in figures, the key switch arrangement may be adapted such that the cover arrangement may be pivoted from the first configuration to the second configuration in an opposite direction than in the embodiment shown in FIGS. 1 and 2, (i.e. in a clock-wise direction). Also in such embodiment, in the first configuration, a first branch section of the cover arrangement may close the opening in the panel plate. The cover arrangement may then be pivoted to the second arrangement in which access to the key switch is enabled. However, in such embodiment, no second branch section is positioned above the key switch while being in the second configuration. Instead, either there is no second branch section or, if a second branch section is provided at the cover arrangement, this second branch section is arranged below the key switch when being in the second configuration. This may have two effects: while, of course, such lacking second branch section or a second branch section arranged below the key switch may not serve as a protecting "roof" e.g. against splash water, an absence of such second branch section may simplify an access to the key switch. Typically, key switch arrangements are position at a relatively low height within an elevator car, e.g. at 80 cm above a car bottom, and any protecting second branch section extending like a roof above the key switch may hinder access to the key switch. Avoiding such obstacles may simplify use of the key switch.

In all embodiments, an information relating to a purpose of the key switch (17) and/or relating to a handling of the key switch arrangement 7 may be visualized at a front side of the cover arrangement (13), i.e. for example at a surface of the first branch section 29 extending towards the front side of the panel plate 3 when being in the first configuration. Such information may be written or symbolic. For example it may be written "fire switch" or a symbol indicating fire may be visualized. It shall be noted that basically any other key switch function can be fixed behind the cover, fire is the main reason, but also reservation car fan, car light could be an option). Further, for indicating a handling of the key switch arrangement, it may be written "turn here" or "press here" or simply a symbol of an arrow may indicated a motion direction. The information may be engraved, imprinted, glued on or visualized in any other way.

Finally, it should be noted that the term "comprising" does not exclude other elements or steps and the "a" or "an" does not exclude a plurality. Also elements described in association with different embodiments may be combined.

In accordance with the provisions of the patent statutes, the present invention has been described in what is considered to represent its preferred embodiment. However, it should be noted that the invention can be practiced otherwise than as specifically illustrated and described without departing from its spirit or scope.

LIST OF REFERENCE SIGNS

1 operating panel
3 panel plate
5 human machine interface
7 key switch arrangement
9 opening
11 push buttons
13 cover arrangement
15 hinge
17 key switch
19 opening in cover arrangement
21 front portion of key switch
23 body of key switch
25 key cylinder
27 key slot
29 first branch section
31 second branch section
32 third branch section
33 sealing
35 vertical pivoting direction
37 horizontal pivoting direction
39 spacer
41 maximum depth extension
43 maximum depth extension
45 water protection arrangement

The invention claimed is:

1. An operating panel for an elevator having an elevator control, comprising:

a panel plate having an opening;

a key switch arrangement including a cover arrangement, a hinge and a key switch;

wherein the key switch is attached to the cover arrangement and is adapted for being activated or deactivated by a key being inserted into the key switch and for transmitting activation signals to the elevator control upon activation;

wherein the cover arrangement is attached at the panel plate next to the opening by the hinge; and wherein the cover arrangement is adapted to be displaced between a first configuration in which the key switch is arranged behind the cover arrangement and a pivoted second configuration in which the key switch is accessible from a front side of the panel plate.

2. The operating panel according to claim 1 wherein the cover arrangement is sized to completely cover or fill the opening of the panel plate when the cover arrangement is positioned in the first configuration.

3. The operating panel according to claim 1 wherein the cover arrangement has an L-shaped cross-section formed by a first branch section and a second branch section being arranged transverse to each other.

4. The operating panel according to claim 3 wherein the first branch section is sized to completely cover or fill the opening of the panel plate when the cover arrangement is positioned in the first configuration.

5. The operating panel according to claim 3 wherein the second branch section is sized to completely cover or fill the opening of the panel plate when the cover arrangement is positioned in the second configuration.

6. The operating panel according to claim 3 wherein the first branch section, the second branch section and the hinge are arranged such that the first branch section is positioned over the key switch when the cover arrangement is in the second configuration.

7. The operating panel according to claim 1 including a sealing tightly closing an interface between a border of the opening of the panel plate and the cover arrangement.

8. The operating panel according to claim 1 wherein the hinge permits the cover arrangement to be pivoted from the first configuration to the second configuration in a vertical direction.

9. The operating panel according to claim 1 wherein the hinge permits the cover arrangement to be pivoted from the first configuration to the second configuration in a horizontal direction.

10. The operating panel according to claim 1 wherein the key switch includes a key cylinder which is not protected against splash water.

11. The operating panel according to claim 1 including a spacer arrangement interposed between the cover arrangement and a front portion of the key switch.

12. The operating panel according to claim 1 wherein the cover arrangement has a portion completely filling the opening of the panel plate when being in the first configuration and being substantially flush with the front side of the panel plate.

13. The operating panel according to claim 1 wherein an information relating to one of a purpose and a handling of the key switch arrangement is visualized at a front side of the cover arrangement.

14. The operating panel according to claim 1 including a human machine interface attached to the panel plate, the human machine interface being adapted for inputting operation instructions by a user upon actuation from the front side of the panel plate and transmitting operation instruction signals to an elevator control.

15. An elevator comprising an operating panel according to claim 1.

16. The elevator according to claim 15 wherein the elevator is a firefighter elevator and the key switch is adapted for transmitting activation signals to the elevator control upon activation in order to authorize enabling of restricted firefighter functions of the elevator.

* * * * *